United States Patent [19]

Norden

[11] Patent Number: 5,000,701

[45] Date of Patent: Mar. 19, 1991

[54] PLUG-IN ELECTRICAL NON-INTERCHANGEABLE CONNECTORS

[75] Inventor: Alexander R. Norden, Boca Raton, Fla.

[73] Assignee: Connectron, Inc., Laurence Harbor, N.J.

[21] Appl. No.: 455,584

[22] Filed: Dec. 22, 1989

[51] Int. Cl.[5] ..... H01R 13/64

[52] U.S. Cl. ..... 439/680; 439/681

[58] Field of Search ..... 439/633, 677, 678, 679, 439/680, 681, 577

[56] References Cited

U.S. PATENT DOCUMENTS 3,112,974 12/1963 Curtis et al. ..... 439/680 X
4,579,412 4/1986 Czeschka et al. ..... 439/680 X

FOREIGN PATENT DOCUMENTS 0199029 10/1986 European Pat. Off. ..... 439/677
0239082 9/1986 Fed. Rep. of Germany ..... 439/677

OTHER PUBLICATIONS

Product Change Bulletin of Phoenix Terminal Block Inc. "MSTB Keying Method", 8-19-1988.
Plug-In Connector of Connectron Inc., Receptacle Part No. MA-0264-003 and Mating Terminal Block.

*Primary Examiner*—Neil Abrams
*Assistant Examiner*—Khiem Nguyen

[57] ABSTRACT

The disclosed non-interchangeable plug-in electrical connector includes a first connection device bearing a series of break-away interference elements, to be broken away selectively; plug-in interference members are plugged into the second connection device, bearing interference elements which, in the preferred embodiment, are break-away elements to be removed selectively so as to become complementary to the retained interference elements of the first device; the plug-in interference members have break-away extensions that facilitate insertion of the interference members, the extensions then being broken away and serving in removal of selected break-away interference elements.

12 Claims, 4 Drawing Sheets

FIG.3
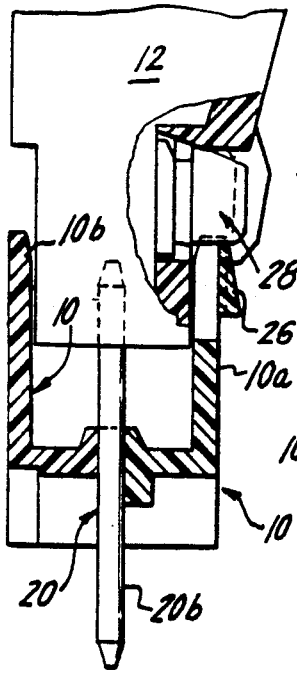
FIG.2
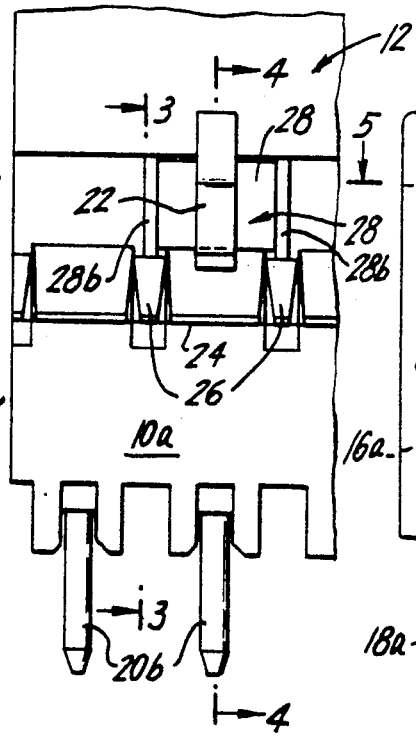
FIG.1
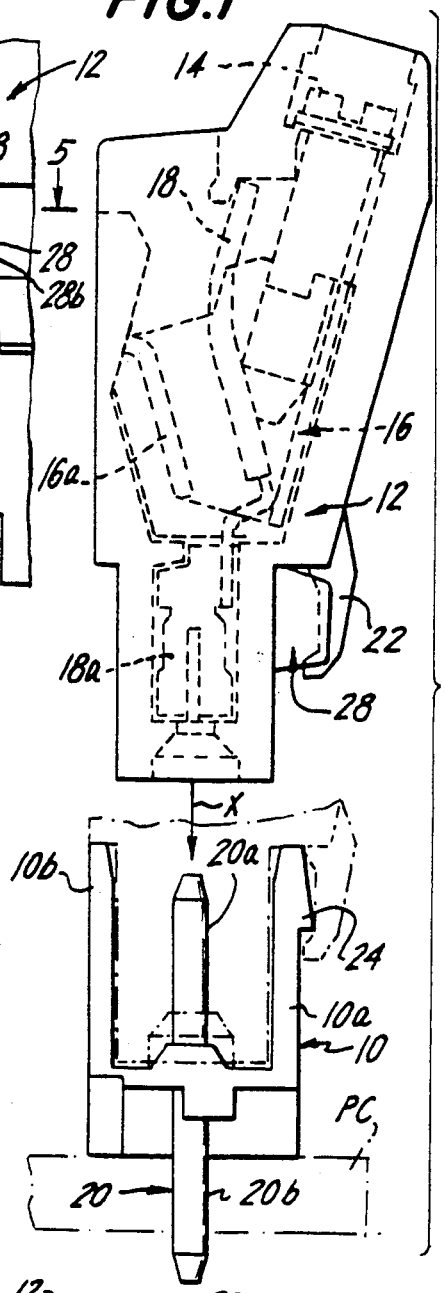
FIG.4
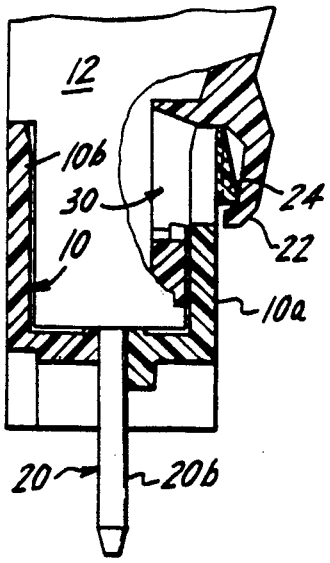
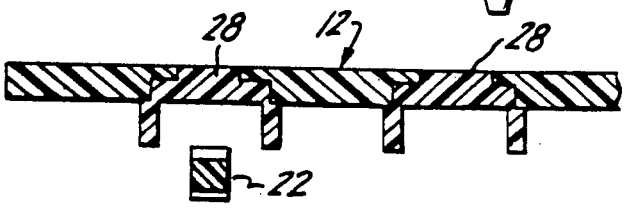
FIG. 5

FIG.6
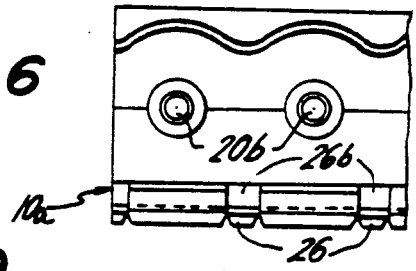
FIG.9
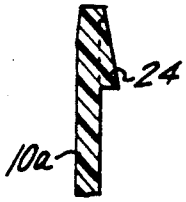
FIG.10
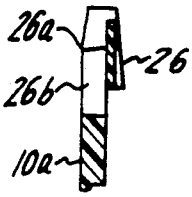
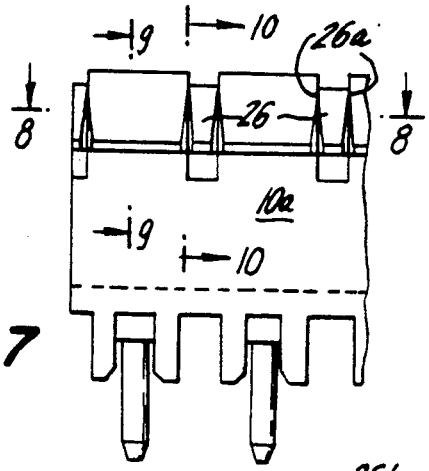
FIG.7
FIG.14
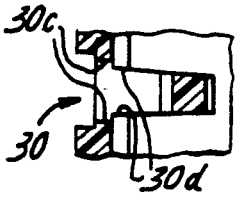
FIG.8
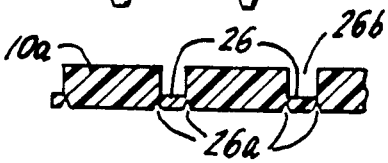
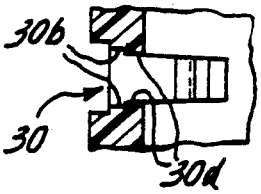
FIG.13
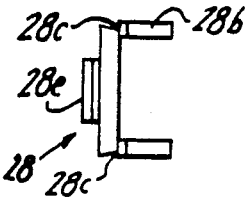
FIG.16
FIG.18
FIG.12
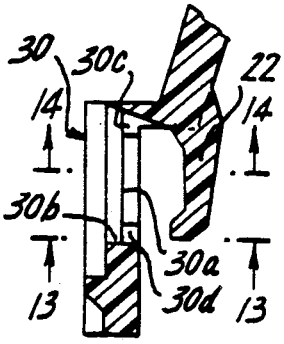
FIG.11
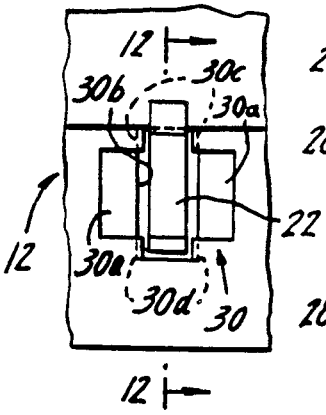
FIG.15
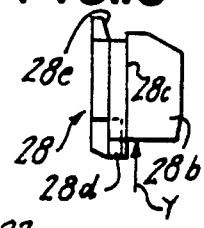
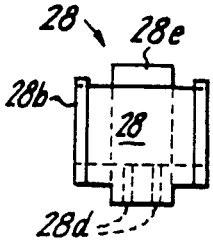
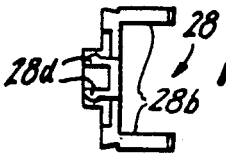
FIG.17

FIG.19
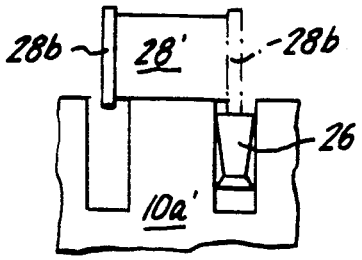
FIG.20
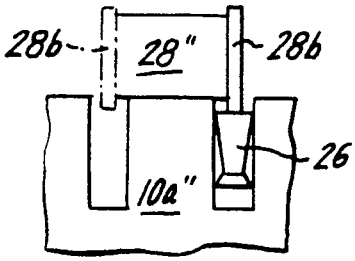
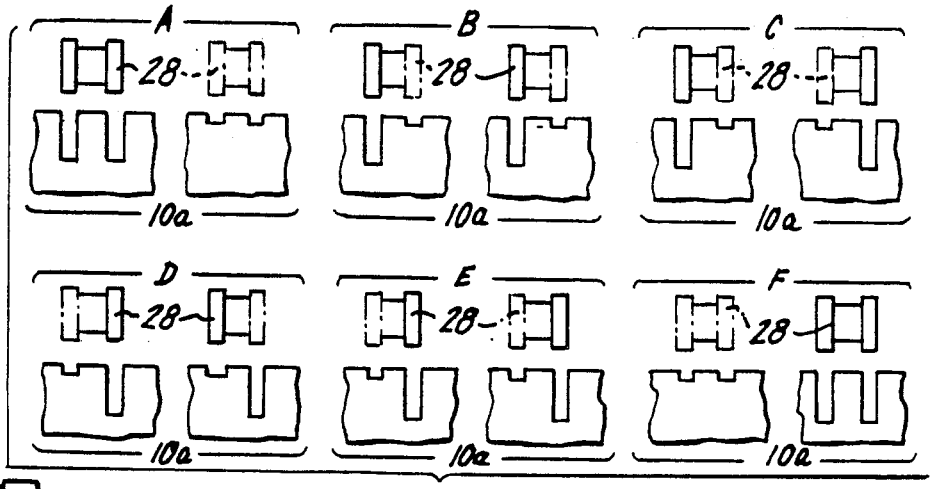
FIG.21
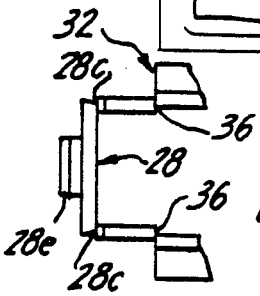
FIG.23
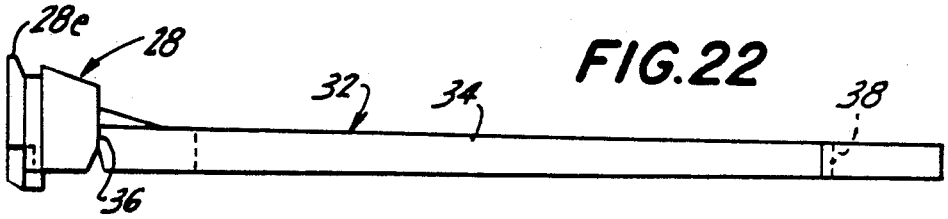
FIG.22
FIG.24
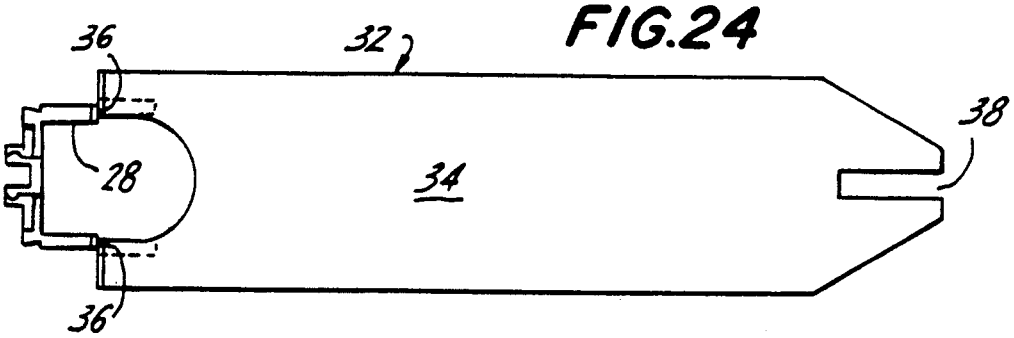

FIG. 25
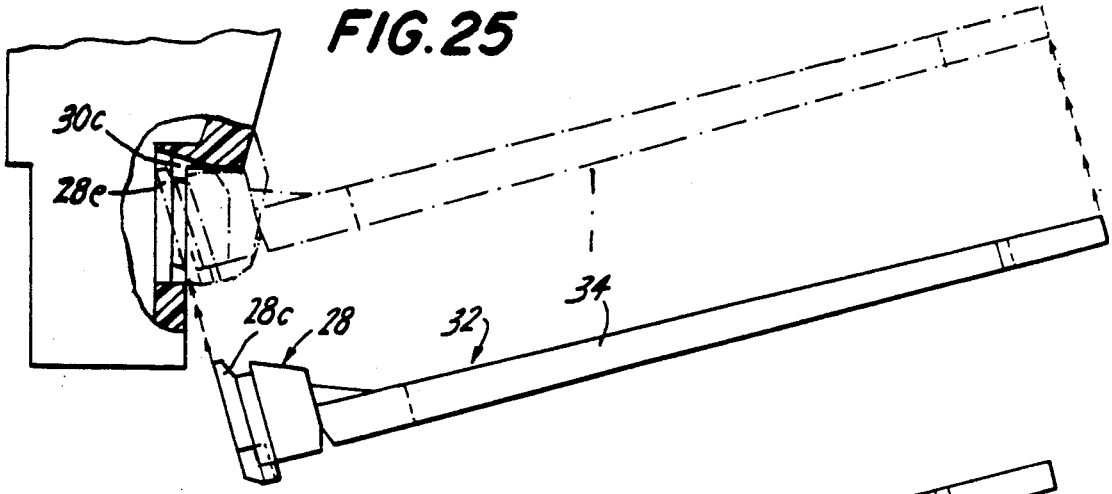
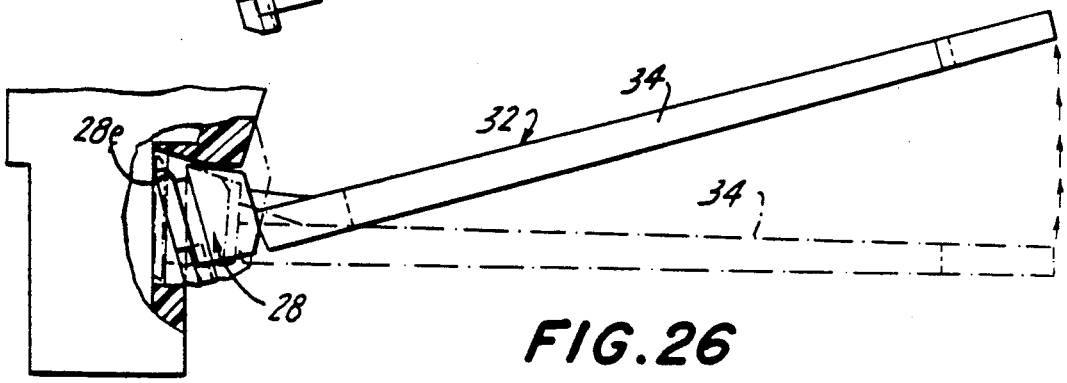
FIG. 26
FIG. 27
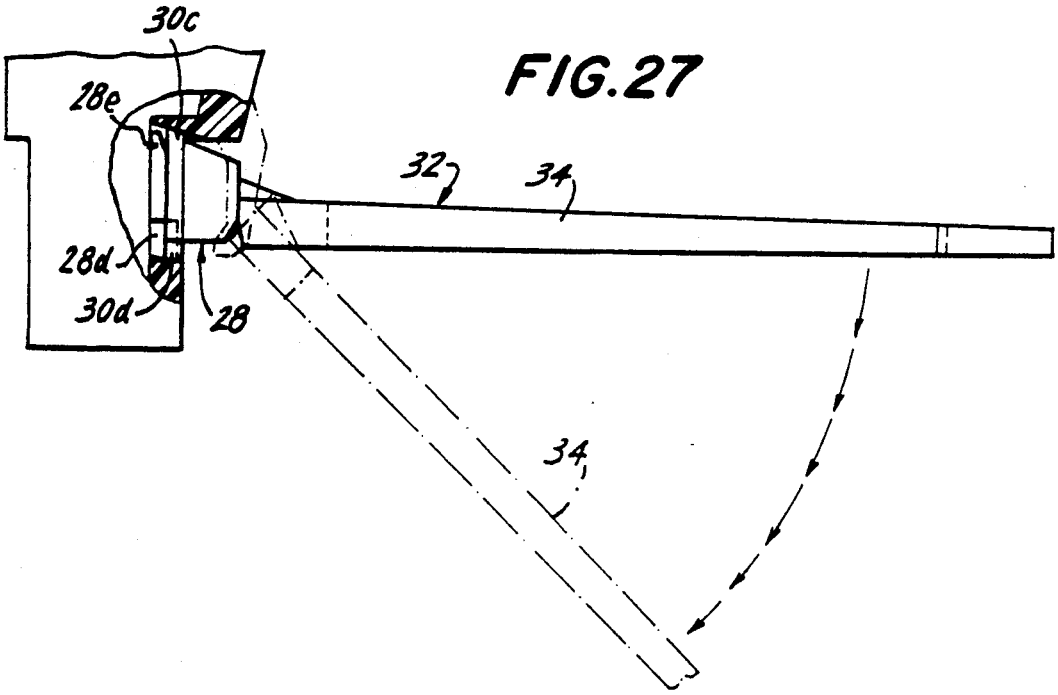

PLUG-IN ELECTRICAL NON-INTERCHANGEABLE CONNECTORS

The present invention relates to electrical connectors providing a range of non-interchangeable mutually complementary pairs of connection devices.

Connectors used for interconnecting two parts of a circuit commonly involve a standard plug-in unit and a standard mating receptacle. In more complicated situations, safeguards are included so that the same basic connectors used in various applications are made non-interchangeable. Distinguishing interference elements render certain plug-in units usable only with receptacles having complementary interference elements.

In one known manner of introducing non-interchangeability in a line of connectors, both of the connection devices—the plug-in units and the mating receptacles—are equipped with a set of break-away interference elements. A non-interchangeable connector is created by breaking away certain of the interference elements of one connection device and breaking away only those interference elements of its mating connection device that correspond to the retained interference elements of the first connection device.

Connectors of this form are equipped with a small number of break-away interference elements; they can be modified to create only a small variety of non-interchangeable connectors. Such connectors can be equipped with many break-away interference elements, but it is necessary to break away many interference elements even if only a small variety of non-interchangeable connectors may be required. This involves a large amount of needless effort in creating a quantity of simple non-interchangeable connectors.

Further, if connectors equipped with break-away interference elements on both mating connection devices of a pair are to be adapted to general-purpose applications, all of the interference elements of one connection device of each pair of devices must be removed. To do so for a quantity of such connectors involves a lot of wasted labor.

In another approach to creating non-interchangeable connectors, both connection devices of a mating pair have a standard construction such that any of the plug-in units may be interchangeably used with any of the receptacles. Interference elements of a first series are selectively assembled to one connecting device of each mating pair, and a complementary series of interference elements are assembled to its companion connecting device. In this way, each connection device and its companion connecting device can be rendered non-interchangeable. A separate manipulation is involved in assembling each one of the many required interference elements, and that effort is multiplied in making a quantity of non-interchangeable connectors.

Improved novel connectors are produced by incorporating a first series of break-away interference elements in one connection device of each mating pair; producing mating or second connecting devices free of interference elements; producing a second series of interference elements and securing them to the second connection devices at locations where they would block interference elements of the first series when pairs of connection devices are to be put together; and breaking away interference elements of at least the first series such that interferences between interference elements of the two connection devices are avoided. In this way, only as many interference members are assembled to the second connection devices of each mating pair as may be needed in creating a small variety or a larger variety of non-interchangeable connectors. Moreover, the connection devices as they are manufactured are useful without modification as general-purpose connectors.

In a distinctive construction of the novel connectors described above, each separate interference member bears multiple break-away interference elements Only as many of these interference members are secured to the second connection member of each connector as are required for distinctively encoding the desired variety of non-interchangeable connectors. After the second connection members have been equipped with this form of interference member, selected break-away elements are removed from the first connection device and complementary break-away elements are removed from the interference members secured to the second connection device of each connector.

In the highly effective embodiment of the invention shown in the accompanying drawings and detailed below, each interference member that is secured to the second connection device of each connector has two break-away elements. Securing only two of such interference members to the second connection device makes it possible to provide six different non-interchangeable connectors. Using three two-element interference members makes it possible to provide twenty (20) varieties of non-interchange connectors. Using only four of such two-element interference members makes it possible to provide seventy (70) varieties of non-interchangeable connectors.

The novel connector has three basic constituents to constitute a non-interchangeable connector: a first connection device having break-away interference elements, a second connection device, and a complement of interference elements to be assembled to the second connection device. Breaking away certain interference elements on one connection device matching the interference elements retained on the other connection device creates a variety of non-interchangeable connectors. Where only a small number of diverse non-interchangeable connectors may be needed, it is only necessary to assemble a small number of interference elements to the second connection device, but the same first and second connection devices have the capacity of providing a large number of diverse connectors by assembling only a relatively modest number of interference elements to the second connection device. Moreover, the first and second connection devices in their as-manufactured condition, with no modification, constitute general-purpose connectors that are fully interchangeable.

The nature of the invention in its various aspects may be better understood by considering the illustrative embodiment shown in the accompanying drawings and the detailed description, below, of that embodiment and certain variations of that embodiment.

In the drawings:

FIG. 1 is an end elevation of a receptacle and a novel plug-in unit aligned with the receptacle before the plug-in unit is inserted, being an illustrative embodiment of the invention;

FIG. 2 is a fragmentary front elevation of the apparatus of FIG. 1, as seen from right of that Figure, wherein mutually engaging interference elements block full assembly;

FIG. 3 is a fragmentary end elevation, partly in cross-section at the plane 3—3 in FIG. 2, of the apparatus of FIG. 2;

FIG. 4 is a fragmentary end view, partly in cross-section at the plane 4—4 in FIG. 2, of the apparatus of FIGS. 1 to 3, omitting a rejection or interference member of the plug-in unit, the latter being fully plugged into the receptacle;

FIG. 5 is a fragmentary cross-section at the plane 5—5 in FIG. 2 of the apparatus of FIGS. 1-3, a larger fragment of the apparatus being shown in FIG. 5 than in FIG. 2;

FIG. 6 is a fragmentary top plan view of the receptacle of FIGS. 1-4;

FIG. 7 is a fragmentary front elevation of the receptacle of FIG. 6;

FIG. 8 is a fragmentary cross-section at the plane 8—8 in FIG. 7, of the receptacle of FIGS. 1-4, 6 and 7;

FIGS. 9 and 10 are fragmentary cross-sections at the planes 9—9 and 10—10 respectively in FIG. 7, of the receptacle of FIGS. 1-4 and 6-8;

FIG. 11 is a fragmentary front elevation of the plug-in unit of FIG. 4 omitting the interference member shown in FIGS. 1, 2 and 3;

FIG. 12 is a fragmentary cross-section at the plane 12—12 in FIG. 11, of the plug-in unit of FIGS. 1-4;

FIGS. 13 and 14 are fragmentary cross-sections at the planes 13—13 and 14—14 in FIG. 12 of the plug-in unit of FIG. 4;

FIG. 15 is a side elevation of an interference member for assembly to the plug-in unit, also seen in FIGS. 1-3;

FIGS. 16, 17 and 18 are a top plan view, a bottom plan view, and a front elevation, respectively, of the interference member of FIG. 15;

FIGS. 19 and 20 are fragmentary front elevations of the plug-in unit of FIG. 2 with modified interference members of FIGS. 15-18 opposite the modified interference portion of the receptacle shown in FIG. 7;

FIG. 21 is a diagram representing the various unique codes that may be attained with the apparatus of FIGS. 2-18 when the plug-in unit has two of the interference members of FIGS. 15-18;

FIG. 22 is a side elevation of a combined interference member of FIGS. 15-18 and a tool for removing interference elements of the receptacle and the plug-in unit's interference elements;

FIG. 23 is a fragmentary top plan view of the device of FIG. 22;

FIG. 24 is a bottom plan view of the device of FIG. 22; and

FIGS. 25-27 are progressive views of the operation of the device of FIGS. 23-25 in assembling an interference member to the plug-in unit of FIGS. 1, 3 and 4.

FIGS. 1-18 and 25-27 are enlarged, being approximately four times as large as the actual parts in a practical example.

In the drawings, the illustrative connector includes first and second connection devices, being a receptacle 10 and a plug-in device 12. The connection devices are shown separated in FIG. 1; the arrow X shows the plug-in path of device 12.

The internal construction of device 12 is shown and claimed in U.S. Pat. No. 4,810,212. It includes a screw 14, a screw-operated clamp 16 and a contact member 18, contained in an enclosure of molded plastic insulation. Operation of the screw draws clamp 16 upward along a slant path such that jaw 16*a* of the clamp grips an inserted wire against contact member 18. Contact member 18 extends to a resilient plug-in contact 18*a*.

Receptacle 10, which is of molded plastic insulation, has opposite front and back walls 10*a* and 10*b* that form a cavity to receive a portion of the plug-in device 12. A pin 20 is fixed in receptacle 10; portion 20*a* is a contact that enters the plug-in unit 12 and is gripped by plug-in contact 18*a*. Portion 20*b* projects downward, to extend through printed circuit board PC and below the printed circuit board far enough to be readily soldered to a terminal on the lower surface of printed circuit board PC. When the plug-in unit has been fully plugged into the receptacle as shown in FIG. 4, contact 20*a* is gripped by contact 18*a*. A wire gripped between contact 18 and jaw 16*a* is then connected to a terminal of the printed circuit board that is soldered to terminal 20*b*. A resilient hook 22 of plug-in unit 12 is releasably latched to detent 24 of receptacle 10 (FIG. 4) to resist unintended release or movement of the plug-in unit after it has been plugged into the receptacle. Only one of many hooks 22 is shown in the drawings.

Two terminals 20*b* are shown in FIG. 2. In practice there may be a row of many terminals 20*b*, twenty-four in an example, and a corresponding number of terminals 18*a*. A unit of electrical equipment often has multiple receptacles 10 secured by soldered joints of their terminals 20*b* to a printed circuit board PC or multiple printed circuit boards in that equipment. Only one particular plug-in unit 12 should be plugged into any particular receptacle 10. The connector 10/12 has means, detailed below, for rejecting any plug-in unit that is not the right one for any particularly receptacle.

FIGS. 6-10 show break-away interference elements 26 that are integral spaced-apart portions of the front wall 10*a* of the receptacle. Those interference elements are fixed by slender joints 26*a* to flanking portions of the wall that provide detents 24. There are recesses 26*b* behind the elements 26. Joints 26*a* are strong, in resisting force applied to elements 26 either downward or perpendicular to wall 10*a*, but joints 26*a* are readily broken when a tool is applied to an element 26 and tilted.

FIGS. 15-18 show an interference member 28 of somewhat resilient molded plastic. This member is to be assembled to the plug-in unit 12 (FIGS. 1-3). Member 28 includes base 28*a* that has two levels. At a front level, base 28*a* has a generally rectangular front area. Parallel interference elements 28*b* extend forward from base 28*a*; they are fixed by thin joints 28*c* to the base. These joints 28*c* are relatively long so as to resist a force applied to element 18*b* in the direction of arrow Y (FIG. 15). This is the direction of a force that would be applied by an opposite interference element 26 of receptacle 10. However, each joint is readily breakable by a tool that tilts an element 28*b* about an axis perpendicular to base 28*a*.

The lower end of base 28*a* (see FIGS. 17 and 18) has spaced-apart detent formations 28*d*; they are interconnected by a thin web so that they resiliently resist being squeezed toward each other.

A rear rectangular layer of base 28*a* is narrower than its front level as seen in FIG. 18; this rear layer has tab portion 28*e* that projects clear of the upper-level wide area of the base.

The molded-plastic enclosure of plug-in unit 12 is free of interference elements in the FIGS. 4, 11 and 12. It can be freely plugged into receptacle 10, so that the receptacle and the plug-in unit as manufactured are useful without modification as an interchangeable connector (FIG. 4).

The front wall of the molded plastic enclosure of the plug-in unit has a series of cavities 30 (FIGS. 4 and 11–14) to receive interference members 28. At an outer level of the front wall, there is a wide generally rectangular recess (FIG. 11) having two wall portions 30*a* at a rear level. The front-level relatively wide area of base 28*a* of interference member 28 bears against areas 30*a*. A narrow rectangular opening 30*b* at a rear level of the recess receives the lower-level portion of base 28*a*.

When an interference member is being assembled to a plug-in unit (in the manner detailed below) tab portion 28*e* is tucked behind overhang portions 30*c*. (These overhang portions would be one continuous overhang, but for the practical limitations of molding hook 22 that extends over cavity 30.) Detents 28*d* are forced past the constricting edges of overhangs 30*d* of cavity 30. Detents 28*d* are squeezed toward each other; and finally detents 28*d* snap apart under front-level or outer-level cooperating detent formations 30*d* at the bottom (FIG. 11) of cavity 30. Member 28 is thus plugged-in and supported and retained in recess 30 by the described coacting formations of the base 28*a* and the plastic enclosure of plug-in unit 12.

Interference member 28 of FIGS. 1–3 and 15–18 is part of a larger device 32 (FIGS. 22–27) as it is manufactured. Additional to interference member 28, device 32 includes a lever portion 34 that is fixed to member 28 by break-away joints 36. Additionally, lever 34 has a recess 38 that is complementary to interference element 26 and to break-away interference element 28*b*. Device 32 has two roles in modifying units 10 and 12, to render them non-interchangeable with differently modified units 10 and 12.

When a member 28 is to be assembled to a plug-in unit 12, tab portion 28*e* of base 28*a* is tucked under overhang portions 30*c* of the plug-in unit (FIG. 25). Member 32 is then swung about pivot elements 28*e* and 30*c* (FIG. 26) until the wide front level of the base 28*a* bears against support areas 30*a* (FIG. 11; FIG. 27). As this occurs, detent formations 28*d* of member 28 become interlocked with retentive formations 30*d* of the plug-in unit. Finally, lever 34 is forced from its solid-line position in FIG. 27 to its dotted-line position so that the lever is removed from the plugged-in interference member 28.

Lever 34 is useful as a tool to break away unwanted interference elements 26 and 28*b*. To do so, lever 34 is placed with its formation 38 embracing an interference element 26 or 28*b*, and the tool is then tilted about an axis perpendicular to the break-away joint 26*a* or 28*c*, i.e., about an axis that extends horizontally across elements 26 or about an axis perpendicular to the front of the plug-in unit. Tool 34 is suitably thin.

In FIG. 19, the right-hand interference element 28*b* of an interference member 28' is removed and the left-hand interference element 26 of receptacle wall 10*a'* is removed. The interference elements of member 28' and wall 10*a* in FIG. 19 are non-interfering, so that a plug-in unit bearing interference member 28' can be plugged into a receptacle whose wall 10*a'* is modified as shown. Conversely, the retained interference elements 26 and 28*b* of wall 10*a''* and member 28'' in FIG. 20 are interfering. Hence, a plug-in unit bearing member 28'' aligned with a portion of a receptacle wall as shown in FIG. 20 is obstructed by aligned interference elements 26 and 28*b*. Plug-in unit 12 is blocked (FIGS. 2 and 3).

An interference member 28 may be used with both of its interference elements intact (FIG. 2) or with one of its interference elements broken away (FIGS. 19 and 20). Theoretically, an interference member 28 might also be used with both of its break-away elements 28*b* removed; but then, such an interference member might well be simply omitted—not assembled to a plug-in unit. FIGS. 21 A–F show how two interference members 28 may be used on a plug-in unit with a series of break-away elements 26 of a receptacle to create six different non-interchangeable connectors. The dotted line representations of portions of members 28 in FIG. 21 represent removed interference elements 28*b*; the deep notches in wall 10*a* represent removed interference elements 26.

In FIGS. 21 A–F, the series of retained elements 28*b* are: first and second; first and third; first and fourth; second and third; second and fourth; and third and fourth. The removed interference elements of wall 10*a* correspond to the retained elements 28*b*. No plug-in unit of any FIG. 21 A–F can be plugged into any receptacle 10 except its companion, as illustrated. Notably, there is no succession of three removed elements 26 and one retained element 28*b* in this sequence of illustrated combinations; without going into detail, such a configuration would not represent rigorously non-interchangeable connection devices. Moreover, to remove four successive interference elements 28*b* or to remove four successive elements 26 would result in a freely interchangeable connector.

Cavities 30 are provided in the molded insulation of plug-in unit 12 for as many plug-in interference members 28 as are needed for the required variety of non-interchangeable connectors 10/12. With a third cavity 30, three members 28 can be used, for a potential of twenty non-interchangeable connectors. Also, the same two members 28 as in the above example can be used in various combinations of cavities: members 28 in the first and second cavities 30 (the above example) or in the first and third cavity 30, or in the second and third cavity 30, for a potential of eighteen non-interchangeable connectors.

Members 28 can be modified so as to have three or more elements 28*b* rather than the two elements 28*b* in the above-described exemplary form.

As a further alternative, member 28 may have only one interference element 28*b* and unit 12 may have a series of modified cavities 30 in alignment with respective interference elements 26 of receptacle 10. In this modification, modified members 28 would be plugged-in at selected positions without breaking away any interference elements 28*b* afterward.

The above-described embodiment of the invention and modifications may be varied still further by those skilled in the art; consequently, the invention should be construed broadly in accordance with its true spirit and scope.

What is claimed is:

1. An electrical connector comprising first and second connection devices having respective contacts that are in engagement when the connection devices are operatively assembled, a first series of interference elements in the form of integral break-away portions of the first connection device, selective removal of said break-away portions resulting in a first series of retained first interference elements and gaps, and companion interference means comprising a plurality of interference members each of which has a base bearing plural break-away portions, said portions of said interference members collectively constituting a second series of second interference elements, said second connection device and each second interference member having mutually complementing plug-in securing formations, respective break-away portions of said first connection device and of said interference members in their as-manufactured condition being paired mutual obstructions against the connection devices being operatively assembled, but said break-away portions being selectively removable to provide said first and second connection devices with complementary sets of interference elements.

2. An electrical connector as in claim 1 wherein said plug-in securing formations include overhang portions of said second connection device for overlying parts of respective bases of a plurality of said interference members and support portions for abutting engagement by the respective bases of the plurality of said interference members, and said plug-in securing formations including cooperative detent portions of said second connection device and each of the plurality of interference members.

3. An electrical device as in claim 1 wherein each of said interference members includes an extending lever for facilitating plug-in assembly of such interference member to said second connection device, each lever being adapted to be broken away from the remainder of its interference member and said levers having formations fitting the interference elements of said first connection device and of said interference members for breaking away selected interference elements.

4. An electrical connector as in claim 1 wherein said first and second connection devices have respective first and second walls that are mutually opposed when the connection devices are operatively assembled, said break-away portions of said first connection device being break-away portions of said first wall, and the plug-in formations of said second connection device being provided by said second wall so that the interference elements of the interference members and interference elements of the first series constitute paired mutual obstructions, as aforesaid.

5. An electrical connector comprising first and second connection devices having respective contacts that are in engagement when said connection devices are operatively assembled, said first connection device having a first series of break-away first interference elements, companion interference members for providing a second series of break-away second interference elements, said companion interference members having plug-in connection to said second connection device located so that said first interference elements in their as-manufactured condition constitute obstructions paired with respective interference elements of said companion interference members, the first and second series of interference elements being adaptable to be mutually complementary by at least breaking away selected first and second interference elements for enabling a multiplicity of non-interchangeable connectors to be formed.

6. An electrical connector as in claim 5 wherein multiple second break-away interference elements are carried by one or more of said companion interference members in their as-manufactured condition, being readily adaptable to provide a modified set of retained interference elements for said second connection device.

7. An electrical connector as in claim 6 wherein each said interference member that bears multiple breakaway interference elements has a manipulative extension joined to the remainder of such member by a break-away connection, said manipulative extension, when removed, being adapted to cooperate with the first and second interference elements individually for selectively removing interference elements and thereby enabling said first and second series of interference elements as manufactured to be converted into mutually complementary first and second mutually complementary sets of interference elements in which only selected interference elements are retained among the as-manufactured interference elements.

8. A modifying device for adapting companion first and second plug-in devices of a connector so that they can be plugged into one another yet being non-interchangeable with differently adapted plug-in devices, the first plug-in device in its as-manufactured condition having a series of break-away interference elements and said second plug-in device having multiple formations for retentively receiving interference members, said modifying device comprising an interference member and a tool joined to each other by a break-away connection, said interference member having a portion retentively engageable with a said formation and having at least one interference element obstructively engageable with an interference element of the first device in its as-manufactured condition, said tool while extending from said interference member serving as a manipulating tool to facilitate assembly of its connected interference member to said second device and said tool being shaped complementary to the interference elements of said first device and being operable, after being parted from its interference member, to break away selected interference elements of said first plug-in device.

9. A modifying device as in claim 8, wherein said interference element of the interference member has a break-away connection to the rest of said interference member and wherein said interference member has at least one more break-away interference element, said tool being complementary to the individual interference elements of said interference member and being operable to break them away selectively.

10. A modifying device for adapting companion first and second plug-in devices of a connector so that they can be plugged into one another yet being non-interchangeable with differently adapted plug-in devices, the first plug-in device in its as-manufactured condition having a series of break-away interference elements, and the second plug-in device having at least one formation for retentively receiving an interference member, said modifying device including an interference member and a tool joined to each other by a break-away connection, said interference member having a portion retentively engageable with a said formation and having multiple break-away interference elements respectively engageable obstructively with interference elements of the first device, said tool while extending from its interference member serving as a manipulating tool for facilitating assembly of its connected interference member to the second plug-in device and said tool being complementary with said interference elements individually, and being operable, after being separated from its interference member, to break away selected ones of said interference elements.

11. An electrical connector comprising first and second electrical connection devices having respective contacts that are in engagement when the electrical connection devices are operatively assembled, a first series of first interference elements in the form of integral break-away portions of the first electrical connection device, selective removal of said break-away portions resulting in a first series of retained first interference elements and gaps, and companion interference means providing a second series of second interference elements, said second electrical connection device and said companion interference means having mutually complementing plug-in formations for securing the companion interference means to the second electrical connection device, said companion interference means having a manipulative extension joined thereto by a break-away connection for facilitating plug-in assembly of said companion interference means to said second electrical connection device and then to bé removed, said manipulative extension having a formation cooperable individually with said break-away portions of said first electrical connection device for removing said break-away portions selectively and thereby constituting said gaps, said companion interference means being adapted to provide, selectively, a series of second interference elements positioned to enter all of said gaps but not to obstruct any of the retained interference elements of said first series when the first and second electrical connection devices are being assembled.

12. A method of rendering non-interchangeable first and second electrical connection devices which are interchangeable with other first and second electrical connection devices, respectively, in their as-manufactured state, each said first electrical connection device having a first series of first break-away interference elements, including the steps of assembling to a second electrical connection device a plurality of interference members that provide a second series of second interference members so as to constitute mutually obstructing pairs of first and second interference elements when said electrical connection devices are aligned for assembly to each other, and breaking away one interference element of each pair including at least one first interference element and one second interference element.

* * * * *